US008595870B1

(12) United States Patent
Lorenzo

(10) Patent No.: US 8,595,870 B1
(45) Date of Patent: Dec. 3, 2013

(54) PLAYPEN SYSTEM

(76) Inventor: Hector J. Lorenzo, Kissimmee, FL (US)

( * ) Notice: Subject to any disclaimer, the term of this patent is extended or adjusted under 35 U.S.C. 154(b) by 252 days.

(21) Appl. No.: 13/208,059

(22) Filed: Aug. 11, 2011

(51) Int. Cl.
*A47D 7/00* (2006.01)

(52) U.S. Cl.
USPC ..... 5/99.1; 5/98.1

(58) Field of Classification Search
USPC ..... 4/586, 587; 5/93.1, 98.1, 98.2, 99.1, 5/101, 102, 110, 111; 108/125, 127, 108/157.1, 159, 159.12, 158.11; 248/150, 248/165–167, 346.3; 280/31, 647, 648; 297/7–9
See application file for complete search history.

(56) References Cited

U.S. PATENT DOCUMENTS 2,464,866 A 3/1949 Holtz
2,486,054 A * 10/1949 Morse ..... 5/99.1
4,186,454 A 2/1980 Cone
4,819,285 A 4/1989 Fetters
D304,523 S 11/1989 Dillner et al.
5,197,154 A 3/1993 Shamie
5,241,716 A * 9/1993 Kohus ..... 5/99.1
5,363,521 A * 11/1994 Garland et al. ..... 5/99.1
5,454,124 A * 10/1995 Huang ..... 5/99.1
5,560,055 A * 10/1996 Ziegler ..... 5/99.1
5,586,345 A 12/1996 Nielson et al.
5,761,754 A * 6/1998 Cheng ..... 5/99.1
6,185,762 B1 2/2001 Homeyer
6,343,390 B1 * 2/2002 Yang et al. ..... 5/99.1
6,421,850 B1 * 7/2002 Welsh, Jr. ..... 5/99.1
6,851,135 B1 2/2005 Chen

* cited by examiner

*Primary Examiner* — Nicholas Polito

(57) ABSTRACT

A collapsible playpen system featuring a base panel and side panels that form an enclosure for a mattress. Bottom bars, side bars, and top bars separate the base panel and side panels. The bars each feature a center hinge joint allowing for the bars to move between an extended position and a collapsed position for storage purposes. The system also features a carrying case for housing the playpen when not in use.

3 Claims, 7 Drawing Sheets

(ISO View)

playpen in suitcase

1ST VERSION, PLAYPEN AND CASE (Front View)

(Step 1)

(Step 2)

(Step 3)

2nd version FIG. 7
PLAYPEN WITH ATTACHED CASE

Zippers open and case being opened

Case open on one side

PLAYPEN SYSTEM

FIELD OF THE INVENTION

The present invention is directed to a playpen, more particularly to a playpen with a comfortable mattress that can be easily folded for storage.

BACKGROUND OF THE INVENTION

Many playpens do not have comfortable mattresses and oftentimes playpens are hard to assemble and disassemble. The present invention features a novel playpen system that can be easily folded for storage. For example, zippers are in each corner, which allow the playpen system to be opened and closed quickly. The playpen system of the present invention lacks wheels for greater stability and durability.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a playpen system. In some embodiments, the system comprises a base panel having a first side edge, a second side edge, a third side edge, and a fourth side edge; a mattress removably disposed atop the base panel; a first bottom bar disposed along the first side edge of the base panel, a second bottom bar disposed along the second side edge of the base panel, a third bottom bar disposed along the third side edge of the base panel, and a fourth bottom bar disposed along the fourth side edge of the base panel, the bottom bars are collapsible bars each with a center hinge joint; a first side panel extending upwardly from the first bottom bar, a second side panel extending upwardly from the second bottom bar, a third side panel extending upwardly from the third bottom bar, and a fourth side panel extending upwardly from the fourth bottom bar, the side panels are arranged along to form an inner enclosure; a first collapsible side bar is disposed at an intersection of the first side panel and the third side panel, a second collapsible side bar disposed at an intersection of the first side panel and the fourth side panel, a third collapsible side bar disposed at an intersection of the second side panel and the third side panel, and a fourth collapsible side bar disposed at an intersection of the second side panel and the fourth side panel, each collapsible side bar has a center hinge joint; a first top bar disposed on a top edge of the first side panel, a second top bar disposed on a top edge of the second side panel, a third top bar disposed on a top edge of the third side panel, and a fourth top bar disposed on a top edge of the fourth side panel, wherein the top bars are collapsible bars each with a center hinge joint; a first top hinge joint connecting a top end of the first collapsible side bar and a first end of the first top bar, a second top hinge joint connecting a top end of the second collapsible side bar and a second end of the first top bar, a third top hinge joint connecting a top end of the third collapsible side bar and a first end of the second top bar, and a fourth top hinge joint connecting a top end of the fourth collapsible side bar and a second end of the second top bar, the top hinge joints can pivot with respect to the respective top bars; and a first bottom hinge joint connecting a bottom end of the first collapsible side bar and a first end of the first bottom bar, a second bottom hinge joint connecting a bottom end of the second collapsible side bar and a second end of the first bottom bar, a third bottom hinge joint connecting a bottom end of the third collapsible side bar and a first end of the second bottom bar, and a fourth bottom hinge joint connecting a bottom end of the fourth collapsible side bar and a second end of the second bottom bar, the bottom hinge joints can pivot with respect to the respective bottom bars.

Each center hinge joint can move between a locked position and a moving position, wherein in the locked position the center hinge joint locks its respective bar in an extended position and in the moving position the center hinge joint allows its respective bar to fold to a collapsed position.

Each center hinge joint is operatively connected to a push button, when the push button is pressed its respective center hinge joint moves to the moving position, when the push button is released its respective center hinge joint moves to the locked position.

The system can move between at least an in-use position and a storage position, in the in-use position the bars are each in the extended position, in the storage position each bar is in the collapsed position and a center hinge joint of the first bottom bar is separated and the second collapsible bar and fourth collapsible bar are folded atop the first collapsible bar and third collapsible bar, respectively.

In some embodiments, the side panels are constructed from a material comprising a mesh material, a canvas material, or a combination thereof. In some embodiments, the system further comprises a carrying case for housing the system in the storage position.

DESCRIPTION OF PREFERRED EMBODIMENTS

Referring now to FIG. 1-9, the present invention features a novel playpen system 100 that can be easily folded for storage. The playpen system 100 comprises a base panel 110. In some embodiments, a first bottom bar, a second bottom bar, a third bottom bar, and a fourth bottom bar disposed along the outer edges of the base panel 110. A first side panel 120*a*, a second side panel 120*b*, a third side panel 120*c*, and a fourth side panel 120*d* are arranged along the outer edges (e.g., the bottom bars) of the base panel 110 in a generally rectangular fashion to form an inner enclosure. For example, a first side edge of the first side panel 120*a* is connected to a side edge of the third side panel 120*c*, a second side edge of the first side panel 120*a* is connected to a side edge of the fourth side panel 120*d*, and a bottom edge of the first side panel 120*a* is connected to the first bottom bar of the base panel 110. A first side edge of the second side panel 120*b* is connected to a side edge of the third side panel 120*c*, a second side edge of the second side panel 120*b* is connected to a side edge of the fourth side panel 120*d*, and a bottom edge of the second side panel 120*b* is connected to the second bottom bar of the base panel 110. The side panels 120 may be constructed in a variety of materials, for example a mesh material 126, a canvas material, the like, or a combination thereof.

Figure 3:
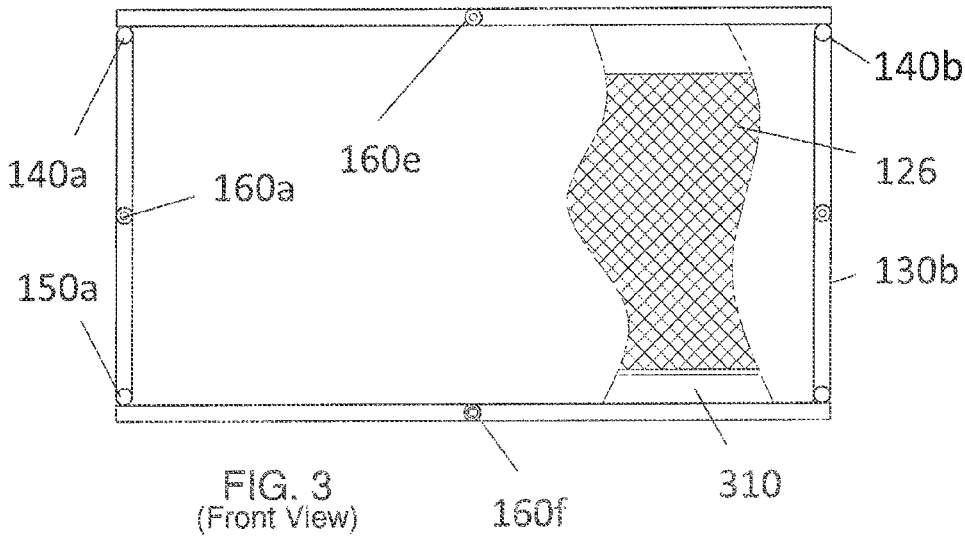
FIG. 3 is a front view of the playpen system of the present invention.
Figure 4:
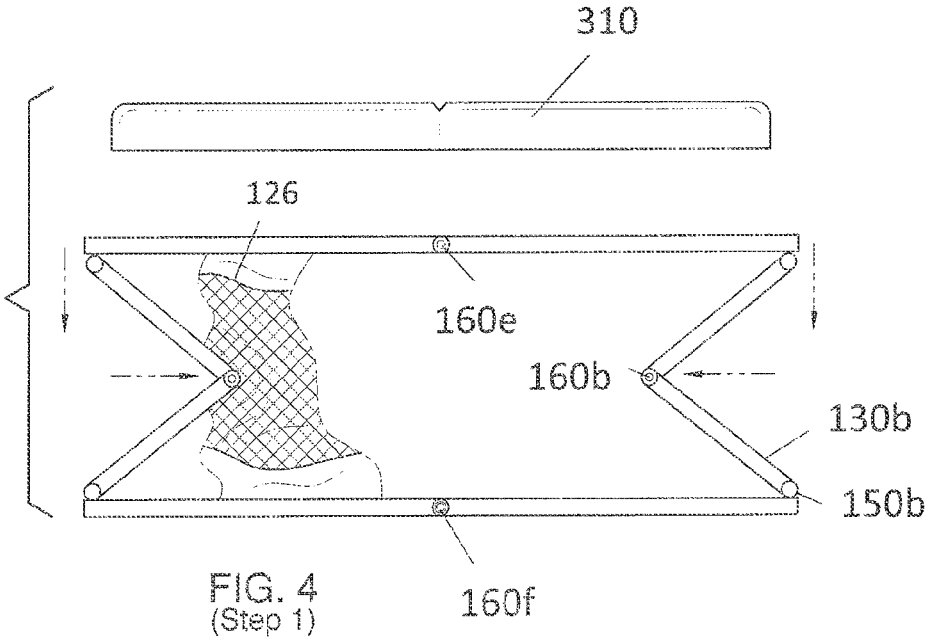
FIG. 4 is a front view of the playpen system of the present invention, wherein the playpen system is in the process of being folded to the storage configuration.

A mattress 310 is disposed atop the base panel 110 (e.g., see FIG. 3). The mattress 310 is designed to be comfortable for infants. The mattress 310 can be folded (e.g., see FIG. 4), for example folded in half.

In some embodiments, a first top bar is disposed on the top edge of the first side panel 120*a*, a second top bar is disposed on the top edge of the second side panel 120*b*, a third top bar is disposed on the top edge of the third side panel 120*d*, and a fourth top bar is disposed on the top edge of the fourth side panel 120*d*.

A first collapsible side bar 130*a* is disposed at the intersection of the first side panel 120*a* and the third side panel 120*c*, a second collapsible side bar 130*b* is disposed at the intersection of the first side panel 120*a* and the fourth side panel 120*d*, a third collapsible side bar 130*c* is disposed at the intersection of the second side panel 120*b* and the third side panel 120*c*, and a fourth collapsible side bar 130*d* is disposed at the intersection of the second side panel 120*b* and the fourth side panel 120*d*. Each collapsible side bar 130 has a center hinge joint at or near the middle area of each collapsible side bar 130. The center hinge joint allows each collapsible side bar 130 to move between at least an extended position (e.g., see FIG. 3) and a collapsed position (e.g., see FIG. 4, FIG. 5).

In some embodiments, a top hinge joint is disposed at the top end of each collapsible side bar 130. For example, a first top hinge joint 140*a* at the top end of the first collapsible side bar 130*a* engages the first end of the first top bar, a second top hinge joint 140*b* at the top end of the second collapsible side bar 130*b* engages the second end of the first top bar, the top hinge joint at the top end of the third collapsible side bar 130*c* engages the first end of the second top bar, and the top hinge joint at the top end of the fourth collapsible side bar 130*d* engages the second end of the second top bar. The top hinge joints can pivot with respect to the respective top bars.

In some embodiments, a bottom hinge joint is disposed at the bottom end of each collapsible side bar 130. For example, a first bottom hinge joint 150*a* at the bottom end of the first collapsible side bar 130*a* engages the first end of the first bottom bar of the base panel 110, a second bottom hinge joint 150*b* at the bottom end of the second collapsible side bar 130*b* engages the second end of the first bottom bar of the base panel 110, the bottom hinge joint at the bottom end of the third collapsible side bar 130*c* engages the first end of the second bottom bar of the base panel 110, and the bottom hinge joint at the bottom end of the fourth collapsible side bar 130*d* engages the second end of the second bottom bar of the base panel 110. The bottom hinge joints can pivot with respect to the respective bottom bars.

A first push button 160*a* engages the first center hinge joint of the first collapsible side bar 130*a*. A second push button 160*b* engages the second center hinge joint of the second collapsible side bar 130*b*. A third push button engages the third center hinge joint of the third collapsible side bar 130*c*. A fourth push button engages the fourth center hinge joint of the fourth collapsible side bar 130*d*. The push buttons 160 regulate the movement of the center hinge joints. For example, when the push buttons 160 are pressed, the center hinge joints are allowed to pivot to collapse the collapsible side bars 130. When the push buttons 160 are released, the center hinge joints are locked to prevent movement. Such push buttons are well known to one of ordinary skill in the art.

In some embodiment, the first top bar, second top bar, third top bar, and fourth top bar are collapsible bars with center hinge joints. In some embodiments, the first bottom bar, second bottom bar, third bottom bar, and fourth bottom bar are collapsible bars with center hinge joints. A fifth push button 160*e* may engage the center hinge joint of the first top bar, and a sixth push button 160*f* may engage the center hinge joint of the first bottom bar. A seventh push button 160*g* may engage the center hinge joint of the second top bar, and a eighth push button may engage the center hinge joint of the second bottom bar.

Figure 5:
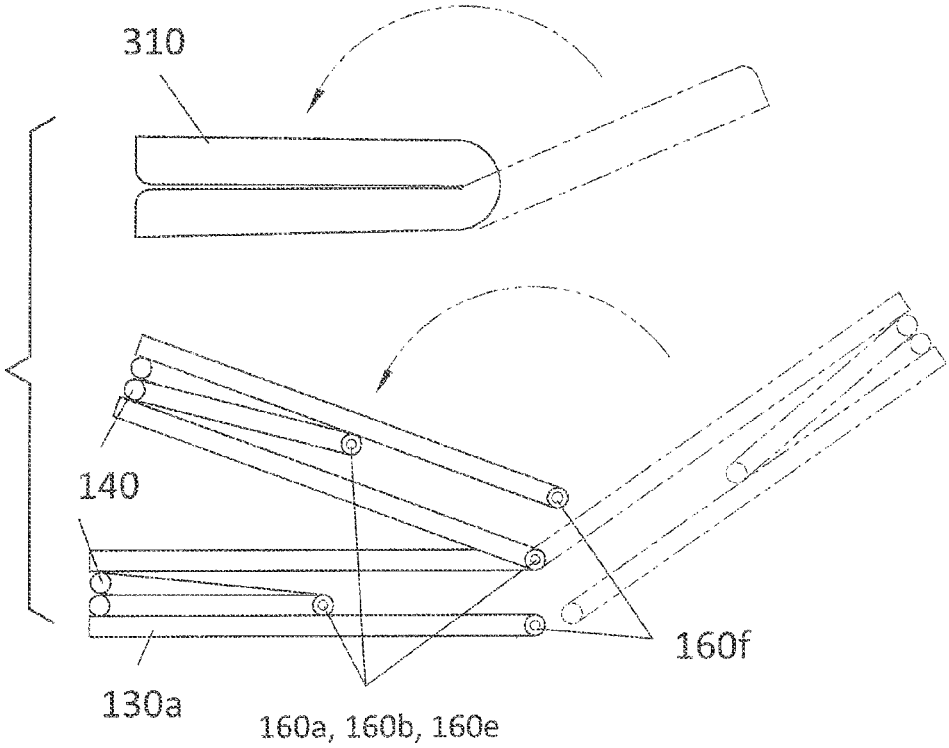
FIG. 5 is a side view of the playpen system of the present invention, wherein the playpen system is in the process of being folded to the storage configuration.

In some embodiments, the center hinge joint of the first bottom bar and the center hinge joint of the second bottom bar can separate. For example, as shown in FIG. 5, the center hinge joint of the first bottom bar is separated to assist with the folding of the system 100.

The system 100 of the present invention can be moved to a storage position. For example, the push buttons 160 can be pushed to operate the center hinge joints, allowing the frame of the system 100 to collapse (see FIG. 3, FIG. 4, and FIG. 5). Then, the center hinge joint of the first bottom bar is separated, and the second collapsible bar 130*b* and fourth collapsible bar 130*d* are folded atop the first collapsible bar 130 and third collapsible bar 130*c*, respectively. The mattress 310 (folded) can be sandwiched between the frame.

Figure 1:
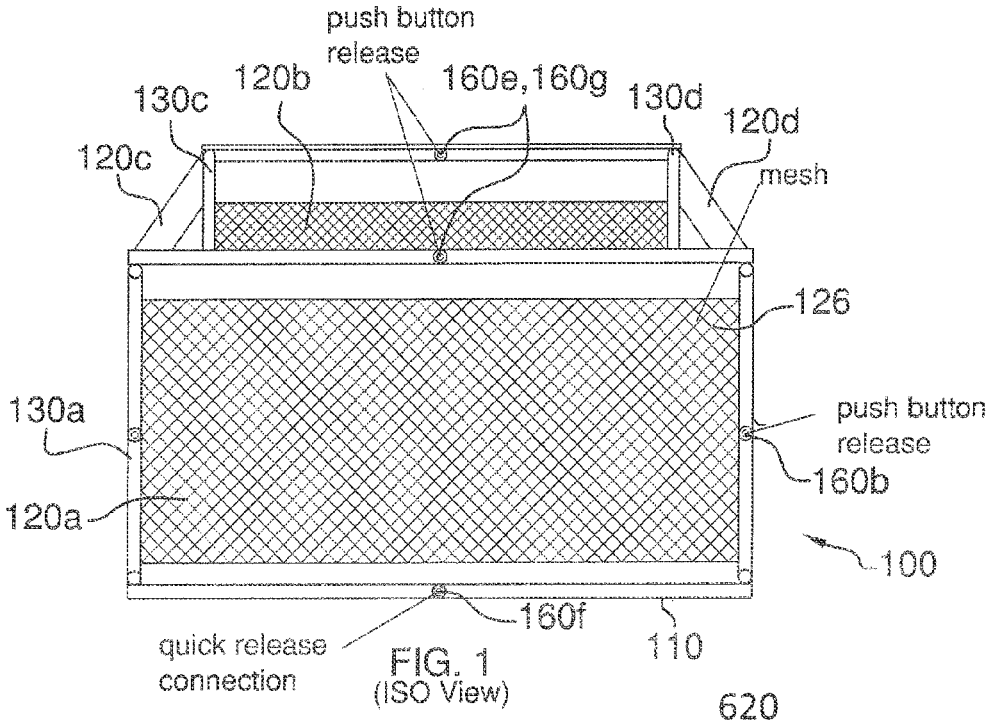
FIG. 1 is a perspective view of the playpen system of the present invention.
Figure 2:
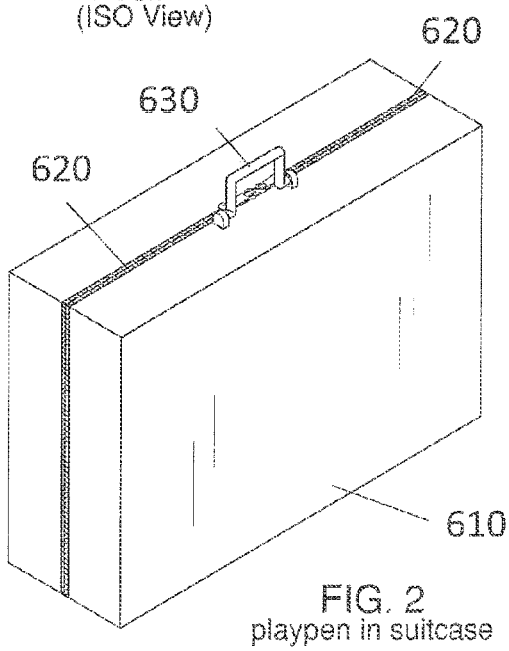
FIG. 2 is a perspective view of the playpen system of the present invention, wherein the playpen system is in the storage configuration.
Figure 6:
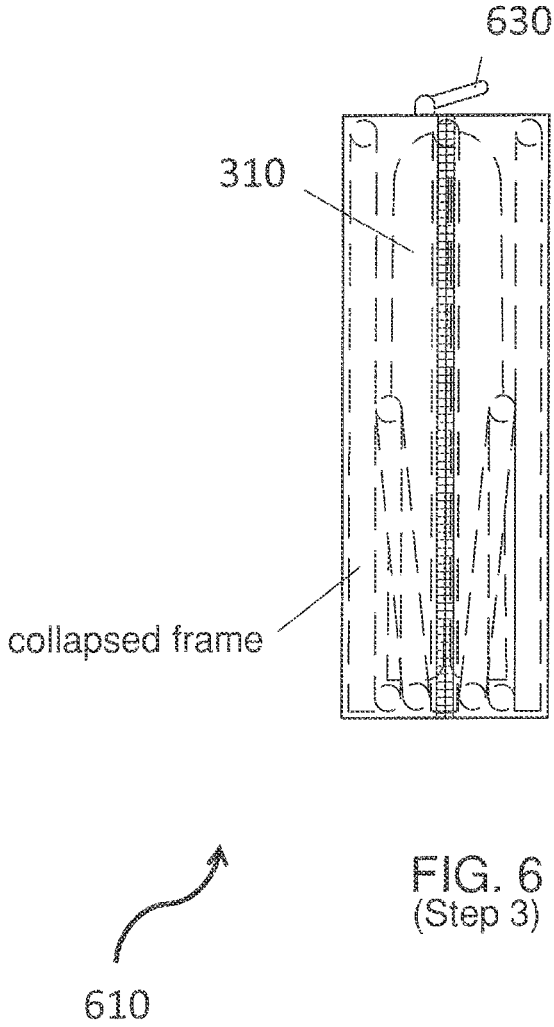
FIG. 6 is a side view of the playpen system of the present invention, wherein the playpen system is in the storage configuration.

In the storage position, the system 100 comprises a carrying case 610 (e.g., see FIG. 2, FIG. 6). In some embodiments, the carrying case 610 comprises zippers 620. In some embodiments, the carrying case 610 comprises a handle 630.

Figure 7:
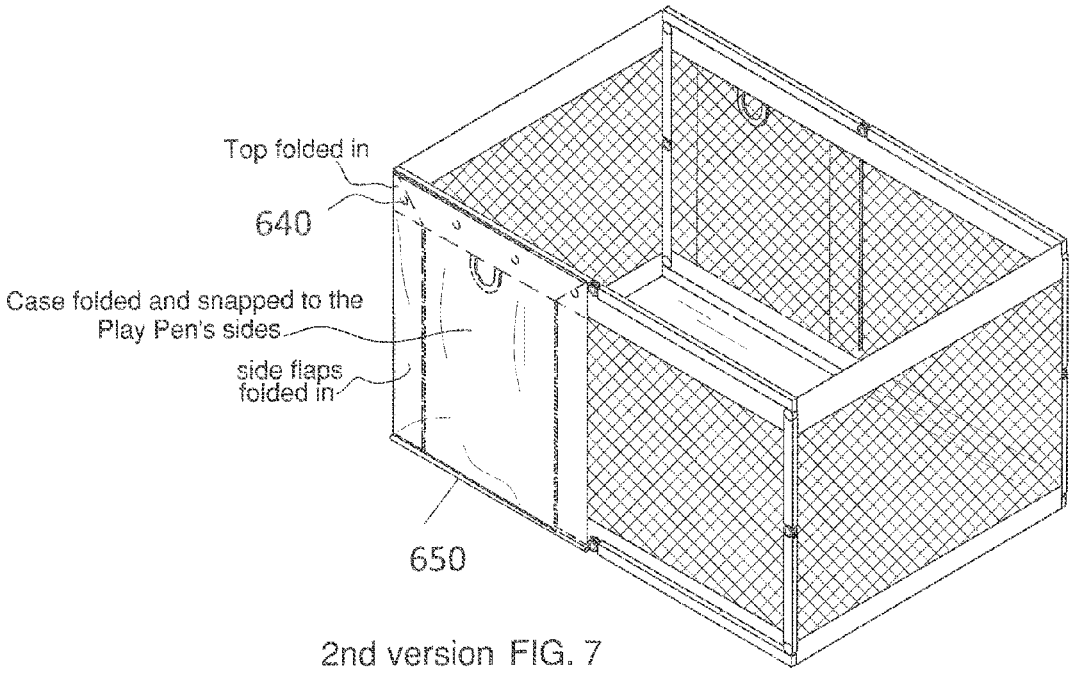
FIG. 7 is an alternative embodiment of the present invention.
Figure 8:
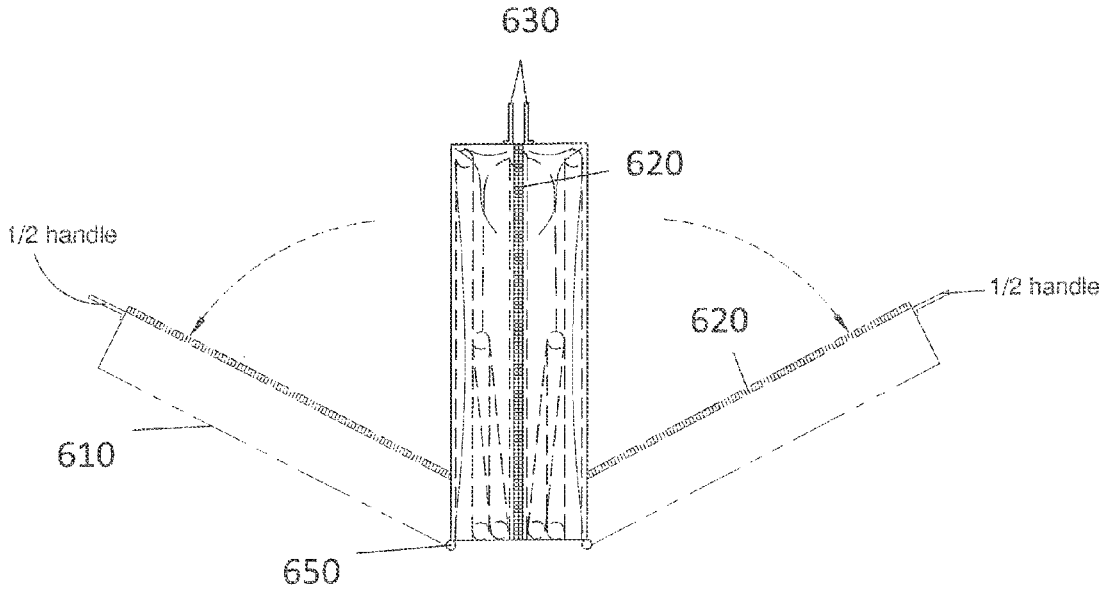
FIG. 8 is an alternative embodiment of the present invention, wherein the carrying case is open on both sides.
Figure 9:
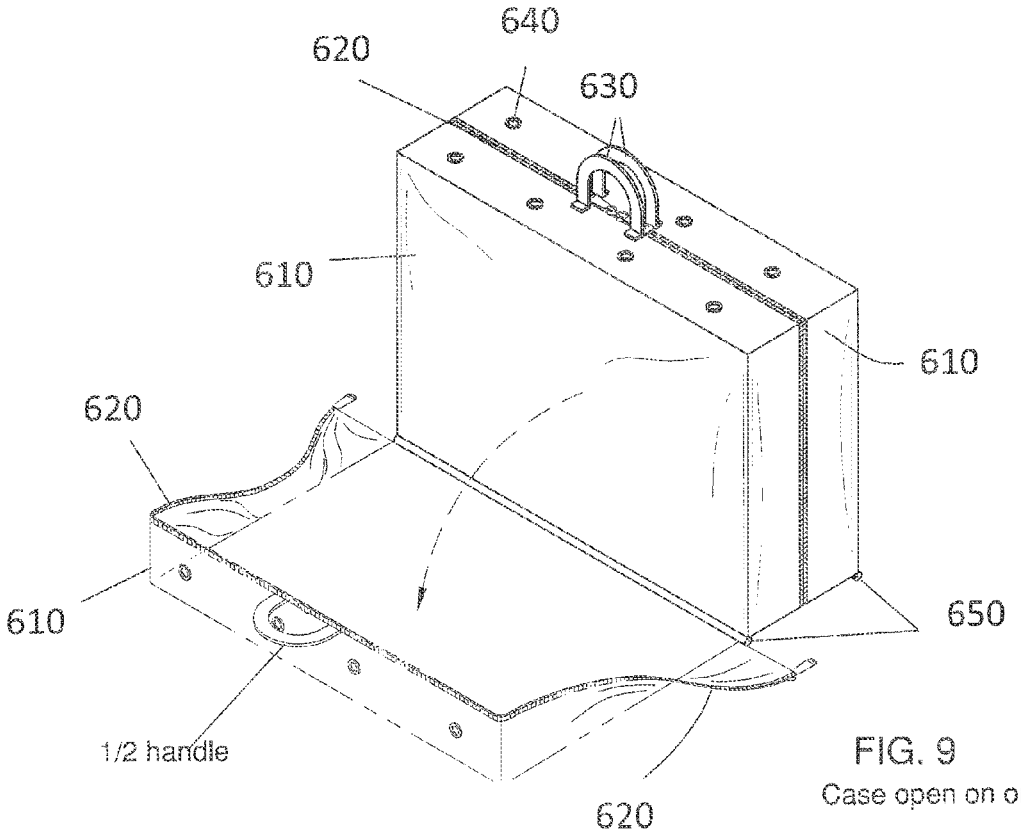
FIG. 9 is an alternative embodiment of the present invention, wherein the carrying case is open on one side.

As shown in FIG. 7-9, in some embodiments, the carrying case 610 is attached to a side panel. For example, the carrying case 610 may be a soft case. One or more snaps 640 may be disposed on the carrying case 610, allowing for attachment to a side panel. In some embodiments, the snaps 640 only function to hold the carrying case 610 to the system 100 (e.g., the side panel). FIG. 7 shows side flaps folded in and the top folded in. Also shown is an attachment/pivot point 650. The sides of the case pivot with respect to the bottom surface via the attachment/pivot points 650 (see also FIG. 8).

The disclosures of the following U.S. Patents are incorporated in their entirety by reference herein: U.S. Pat. No. 6,185,762; U.S. Pat. No. 4,186,454; U.S. Pat. No. 6,851,135; U.S. Pat. No. 4,819,285; U.S. Pat. No. 5,197,154; U.S. Design Pat. No. D304,523; U.S. Pat. No. 2,464,866; U.S. Pat. No. 5,586,345; U.S. Pat. No. 5,363,521.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A playpen system 100 comprising:

(a) a base panel 110 having a first side edge, a second side edge, a third side edge, and a fourth side edge;

(b) a mattress 310 removably disposed atop the base panel 110;

(c) a first bottom bar disposed along the first side edge of the base panel 110, a second bottom bar disposed along the second side edge of the base panel 110, a third bottom bar disposed along the third side edge of the base panel 110, and a fourth bottom bar disposed along the fourth side edge of the base panel 110 the bottom bars are collapsible bars each with a center hinge joint;

(d) a first side panel 120*a* extending upwardly from the first bottom bar, a second side panel 120*b* extending upwardly from the second bottom bar, a third side panel 120*c* extending upwardly from the third bottom bar, and a fourth side panel 120*d* extending upwardly from the fourth bottom bar, the side panels 120 are arranged along to form an inner enclosure;

(e) a first collapsible side bar 130*a* is disposed at an intersection of the first side panel 120*a* and the third side panel 120*c*, a second collapsible, side bar 130*b* disposed at an intersection of the first side panel 120*a* and the fourth side panel 120*d*, a third collapsible side bar 130*c* disposed at an intersection of the second side panel 120*b* and the third side panel 120*c*, and a fourth collapsible side bar 130*d* disposed at an intersection of the second side panel 120*b* and the fourth side panel 120*d*, each collapsible side bar 130 has a center hinge joint;

(f) a first top bar disposed on a top edge of the first side panel 120*a*, a second top bar disposed on a top edge of the second side panel 120*b*, a third top bar disposed on a top edge of the third side panel 120*d*, and a fourth top bar disposed on a top edge of the fourth side panel 120*d*, wherein the top bars are collapsible bars each with a center hinge joint;

(g) a first top hinge joint 140*a* connecting a top end of the first collapsible side bar 130*a* and a first end of the first top bar, a second top hinge joint 140*b* connecting a top end of the second collapsible side bar 130*b* and a second end of the first top bar, a third top hinge joint connecting a top end of the third collapsible side bar 130*c* and a first end of the second top bar, and a fourth top hinge joint connecting a top end of the fourth collapsible side bar 130*d* and a second end of the second top bar, the top hinge joints can pivot with respect to the respective top bars; and (h) a first bottom hinge joint 150*a* connecting a bottom end of the first collapsible side bar 130*a* and a first end of the first bottom bar, a second bottom hinge joint 150*b* connecting a bottom end of the second collapsible side bar 130*b* and a second end of the first bottom bar, a third bottom hinge joint connecting a bottom end of the third collapsible side bar 130*c* and a first end of the second bottom bar, and a fourth bottom hinge joint connecting a bottom end of the fourth collapsible side bar 130*d* and a second end of the second bottom bar, the bottom hinge joints can pivot with respect to the respective bottom bars;

wherein each center hinge joint can move between a locked position and a moving position, wherein in the locked position the center hinge joint locks its respective bar in an extended position and in the moving position the center hinge joint allows its respective bar to fold to a collapsed position; wherein each center hinge joint is operatively connected to a push button 160, when the push button 160 is pressed its respective center hinge joint moves to the moving position, when the push button 160 is released its respective center hinge joint moves to the locked position;

wherein the system 100 can move between at least an in-use position and a storage position, in the in-use position the bars are each in the extended position, in the storage position each bar is in the collapsed position and a center hinge joint of the first bottom bar is separated and the second collapsible bar 130*b* and fourth collapsible bar 130*d* are folded atop the first collapsible bar 130 and third collapsible bar 130*c*, respectively.

2. The system 100 of claim 1, wherein the side panels 120 are constructed from a material comprising a mesh material 126, a canvas material, or a combination thereof.

3. The system 100 of claim 1 further comprising a carrying case for housing the system 100 in the storage position.

* * * * *